US005721568A

United States Patent [19]

Kim

[11] Patent Number: 5,721,568

[45] Date of Patent: Feb. 24, 1998

[54] FONT ROM CONTROL CIRCUIT FOR ON-SCREEN DISPLAY

[75] Inventor: Ho Hyun Kim, Kyungsangbook-Do, Rep. of Korea

[73] Assignee: LG Semicon Co., Ltd., Cheongju, Rep. of Korea

[21] Appl. No.: 495,876

[22] Filed: Jun. 28, 1995

[51] Int. Cl.[6] ..... G09G 5/24

[52] U.S. Cl. ..... 345/193; 345/194; 395/167

[58] Field of Search ..... 345/141–144, 345/192–195; 395/167, 171

[56] References Cited

U.S. PATENT DOCUMENTS

| | | | |
|---|---|---|---|
| 4,595,996 | 6/1986 | Morley et al. | 345/194 |
| 4,737,779 | 4/1988 | Somigli et al. | 345/193 |
| 4,864,518 | 9/1989 | Kurita | 345/194 |
| 4,954,979 | 9/1990 | Eibner et al. | 345/143 |
| 5,367,317 | 11/1994 | Hosotani | 345/193 |
| 5,467,109 | 11/1995 | Nagaoka | 345/194 |

*Primary Examiner*—Steven Saras
*Attorney, Agent, or Firm*—Fleshner & Kim

[57] ABSTRACT

An improved font ROM control circuit for an on-screen display capable of performing a function of an on-screen display RAM using an address ROM by storing a coded character address and a coded character color data in a plurality of address ROMs and to selectively output data, thereby to cope with an increasing needs of an on-screen display RAM having a large space, which includes an address signal generation circuit for outputting a readout address signal; an on-screen display RAM for storing a character address and a character color data of a character data in according to a record address signal outputted from a central processing unit and for outputting a previously stored character address and a character color data in accordance with a readout address signal; an address ROM for outputting character addresses and character color data in accordance with a readout address signal outputted from the address generation circuit; a memory selection register for outputting a memory selection signal so as to select a character address and for outputting a color memory selection signal so as to select a character color data; and a multiplexer for selecting character addresses and character color data outputted from the on-screen display ROM and the address ROM, respectively, in accordance with a memory selection signal and a character memory selection signal which are outputted from the memory selection register and for outputting the selected character addresses and character color data to a column selection signal generation circuit and an output control circuit, respectively.

4 Claims, 3 Drawing Sheets

FONT ROM CONTROL CIRCUIT FOR ON-SCREEN DISPLAY

BACKGROUND OF THE INVENTION

1. Field of the Invention

The present invention relates to a font ROM (Read Only Memory) control circuit for an on-screen display, and particularly to an improved font ROM control circuit for an on-screen display capable of performing a function of an on-screen display RAM using an address ROM by storing a coded character address and a coded character color data in a plurality of address ROMs, respectively, and to selectively output a data, thereby to cope with an increasing needs of an on-screen display RAM having a large space.

2. Description of the Conventional Art

As shown in FIG. 1, a conventional font ROM control circuit for an on-screen display RAM includes an address signal generation circuit 1 for outputting a readout address signal ADDR, an on-screen display RAM 2 for storing the character address CA and the character color data CCD of the record address signal ADDW and a record data DATA which are outputted from a central processing unit CPU and for outputting a character address signal CA and a character color data CCD in accordance with a readout address signal ADDR outputted from the address signal generation circuit 1, a column selection signal generation circuit 3 for outputting column selection signals CS1 through CSn in accordance with the character address signal CA outputted from the on-screen display RAM 2, a row selection signal generation circuit 4 for outputting row selection signals RS1 through RSn by counting a horizontal synchronous signal Hsync, and a font ROM 5 for storing the font data FD which is to be displayed and for outputting a font data FD in accordance with column selection signals CS1 through CSn outputted from the column selection signal generation circuit 3 and a row selection signal RS1 outputted from the row selection signal generation circuit 4.

The operation of the conventional ROM control circuit for an on-screen display will now be explained.

To begin with, the character address which is to be displayed and the character color data are outputted after the entire space of the on-screen display RAM 2 is selected using a readout address signal ADDR after recording a character address and a character color data.

The central processing unit CPU operates in accordance with a source program previously set in a ROM (not shown) and stores the character data into the on-screen display RAM 2. That is, when the recording data and a record address signal ADDW are outputted to the on-screen display RAM 2, the on-screen display RAM 2 stores the character address CA and the character color data CCD of the record data in accordance with a record address signal ADDW outputted from the central processing unit CPU.

Thereafter, when the readout signal ADDR outputted from the address signal generation circuit 1 is inputted into the on-screen display RAM 2, the on-screen display RAM 2 outputs the character color data CCD and the character address CA to the output control circuit and the column selection signal generation circuit 3, respectively.

In addition, the column selection signal generation circuit 3 receives the character address CA and outputs the column selection signals CS1 through CSn to the font ROM 5, and the row selection signal generation circuit 4 counts the horizontal synchronous signal Hsync and outputs the row selection signals RS1 through RSn to the font ROM 5.

Therefore, the font ROM 5 outputs the font data, which are selected by the column selection signals CS1 through CSn outputted from the column selection signal generation circuit 3 and by the row selection signals RS1 through RSn, to the output control circuit.

Thereafter, the character color data CCD outputted from the on-screen display RAM 2 and the font data FD outputted from the font ROM are outputted to the CRT of a television through the output control circuit.

However, the conventional font ROM control circuit for an on-screen display has disadvantages in that the capacity of a central processing unit should be big to meet an increasing capacity of an on-screen display RAM and the time and the entire applied program for recording the character data in an on-screen display as well as the capacity of a ROM should be big as the use of applied programs increase.

SUMMARY OF THE INVENTION

Accordingly, it is an object of the present invention to provide a font ROM control circuit for an on-screen display, which overcame the problems encountered in a conventional front ROM control circuit.

It is another object of the present invention to provide an improved font ROM control circuit for an on-screen display, which includes an address signal generation circuit for outputting a readout address signal; an on-screen display RAM for storing a character address and a character color data of a character data in according to a record address signal outputted from a central processing unit and for outputting a previously stored character address and a character color data in accordance with a readout address signal; an address ROM for outputting character addresses and character color data in accordance with a readout address signal outputted from the address generation circuit; a memory selection register for outputting a memory selection signal so as to select a character address and for outputting a color memory selection signal so as to select a character color data; and a multiplexer for selecting character addresses and character color data outputted from the on-screen display ROM and the address ROM, respectively, in accordance with a memory selection signal and a character memory selection signal which are outputted from the memory selection register and for outputting the selected character addresses and character color data to a column selection signal generation circuit and an output control circuit, respectively.

DETAILED DESCRIPTION OF THE INVENTION

Figure 1:
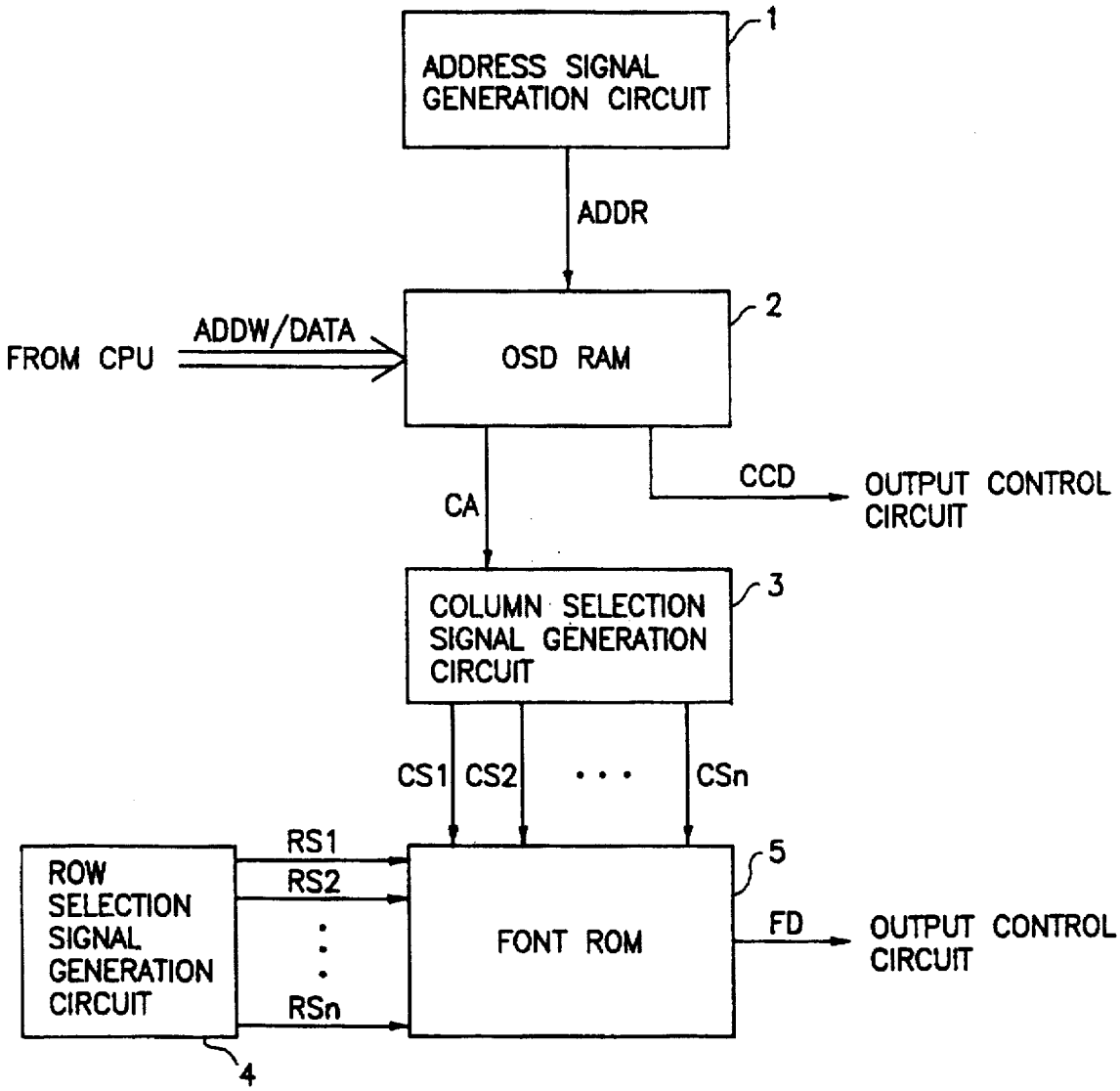
FIG. 1 CONVENTIONAL ART
FIG. 1 is a block diagram of a conventional font ROM control circuit for an on-screen display.
Figure 2:
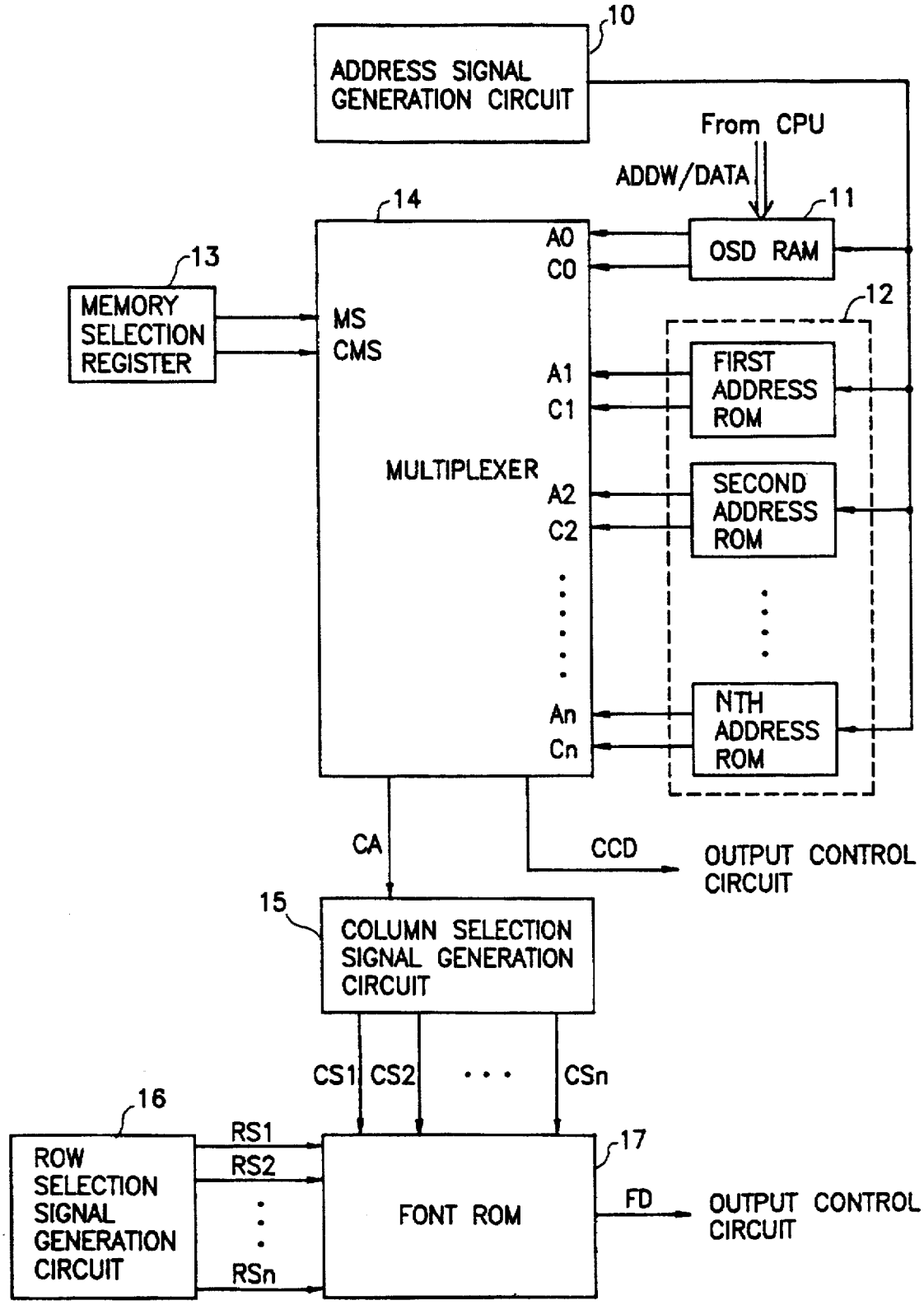
FIG. 2 is a block diagram of a font ROM control circuit for an on-screen display according to the present invention.

Referring to FIG. 2, a font ROM control circuit for an on-screen display according to the present invention includes an address signal generation circuit 10 for outputting an address signal to read out data, an on-screen display RAM 11 for storing a record address signal ADDW outputted from a central processing unit and for outputting a character color data CCDO) (shown as CO in FIGS. 2 and 4) and a character address CAO (shown as AO in FIGS. 2 and 4) in accordance with a readout address signal ADDR outputted from the address signal generation circuit 10, an address ROM 12 for storing a character address CA and a character color data CCD in a coded form and for outputting character addresses CA1 through CAn (shown as A1-An in FIGS. 2 and 4) and character color data CCD1 through CCDn (shown as C1-Cn in FIGS. 2 and 4) in accordance with an address signal outputted from the address signal generation circuit 10, a memory selection register 13 for outputting a character memory selection signal CMS to select a character color data CCD and a memory selection signal MS to select a character address CA, a multiplexer 14 for selecting a character address CAO outputted from the on-screen display RAM 11 and character addresses CA1 through CAn outputted from the address ROM 12 in accordance with a memory selection signal MS outputted from the memory selection register 13 and for outputting the selected signal to the column selection signal generation circuit 15, and for selecting a character color data CCDO outputted from the on-screen display RAM 11 and character color data CCD1 through CCDn outputted from the address ROM 12 in accordance with a character memory selection signal CMS outputted from the memory selection register 13 and for outputting the selected signals to the output control circuit, a column selection signal generation circuit 15 for outputting column selection signals CS1 through CSn in accordance with a character address CA outputted from the multiplexer 14, a row selection signal generation circuit 16 for outputting row selection signals RS1 through RSn by counting a horizontal synchronous signal Hsync, and a font ROM 17 for outputting a font data FD to the output control circuit which is selected by the column selection signals CS1 through CSn outputted from the column selection signal generation circuit 15 and the row selection signals RS1 through RSn outputted from the row selection signal generation circuit 16.

The address ROM 12 includes 'n' address ROMs 1 through n each storing a character address CA and a character color data CCD, in which an address ROM has the same number of the address as the memory size of the on-screen display RAM 11.

Figure 3:
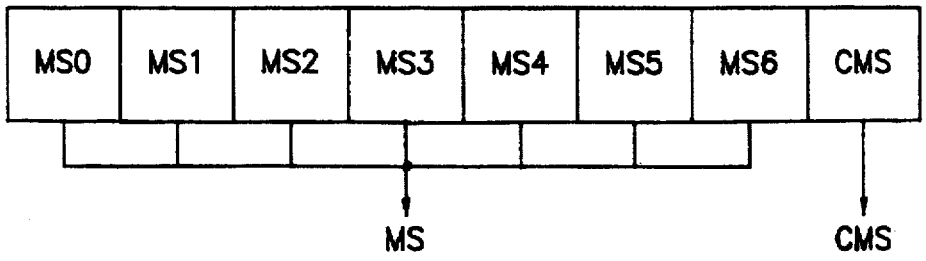
FIG. 3 is a view showing a memory selection register of FIG. 2 in detail.

Referring to FIG. 3, the memory selection register 13 includes 8-bit registers MS0 through MS6, CMS, of which the 8-bit register MS0 through MS6 have a memory selection signal MS for selecting a character address CA and the 8-bit register CMS has a character memory selection signal CMS for selecting a character color data CDD.

Figure 4:
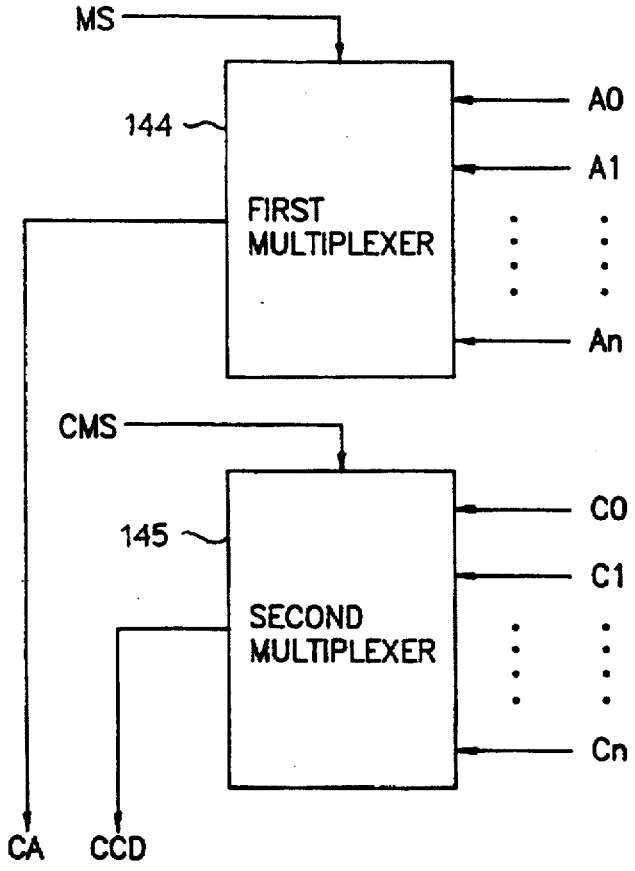
FIG. 4 is a view showing a construction of a multiplexer of FIG. 2.

Referring to FIG. 4, the multiplexer 14 includes a first multiplexer 144 for outputting character addresses CA0 through CAn in accordance with a memory selection signal MS outputted from the memory selection register 13, and a second multiplexer 145 for outputting character color data CCD0 through CCDn in accordance with a color memory selection signal CMS outputted from the memory selection register 13.

The operation of a font ROM control circuit for an on-screen display according to the present invention will now be explained.

To begin with, a character address CA and a character color data CCD are stored in the ROM 12 in accordance with the source program.

Thereafter, the central processing unit CPU outputs a record address signal ADDW and a character data to the on-screen display RAM 11 and records a character address CA and a character color data CCD in the on-screen display RAM 11 in accordance with a record address signal ADDW.

Thereafter, in the address generation circuit 10, a readout address signal ADDR is outputted to the on-screen display RAM 11 and the address ROM 12, and the on-screen display RAM 11 outputs a character color data CCD0 and a character address CA0, and the address ROM 12 outputs character address CA1 through CAn and character color data CCD1 through CCDn to the multiplexer 14.

Thereafter, referring to FIG. 3, a memory selection signal MS for selecting character addresses CA0 through CAn and a color memory selection signal CMS for selecting character color data CCA1 through CCDn are outputted to the multiplexer 14.

Therefore, as shown in FIG. 4, the multiplexer 14 outputs a character color data CCD and a character address CA to the output control circuit and the column selection signal generation circuit 15, respectively, which are selected by the memory selection signal MS and the character memory selection signal CMS outputted from the memory selection register 13 among the character addresses CA0 through CAn and the character color data CCD0 through CCDn outputted from the on-screen display RAM 11 and the address ROM 12, respectively.

In addition, the column selection signal generation circuit 15 receives the character address CA and outputs the column selection signals CS1 through CSn to the font ROM 17, and the row selection signal generation circuit 16 counts the horizontal synchronous signal Hsync and output the row selection signals RS1 through RSn to the font ROM 17.

Thereafter, the font ROM 17 stores the font data FD which is displayed in accordance with a program and outputs the font data FD selected by the column selection signals CS1 through CSn outputted from the column selection signal generation circuit 15 and the row selection signals RS1 through RSn outputted from the row selection signal generation circuit 16 to the output control circuit.

Therefore, the character color data CCD outputted from the multiplexer 14 and the font data FD outputted from the font ROM 17 are combined by the output control circuit and are outputted to the CRT of the television.

As described above, the font ROM control circuit for an on-screen display according to the present invention is directed to provide an address ROM capable of recording data on and reading out from the on-screen RAM by providing a plurality of address ROMs in which a character address and character color data are stored in a coded form so as to implement one on-screen display to an address ROM, thereby to cope with an increasing needs of an on-screen display RAM having a large space.

What is claimed is:

1. A font ROM control circuit for an on-screen display, comprising:

an address signal generation circuit for outputting a readout address signal;

an on-screen display RAM for storing a character address and a character color data of a character data in accordance with a record address signal outputted from a central processing unit and for outputting a previously stored character address and a character color data in accordance with a readout address signal;

an address ROM for outputting character addresses and character color data in accordance with a readout address signal outputted from the address signal generation circuit;

a memory selection register for outputting a memory selection signal so as to select a character address and for outputting a color memory selection signal so as to select a character color data; and a multiplexer for selecting character addresses and character color data outputted from the on-screen display RAM and the address ROM, respectively, in accordance with a memory selection signal and a character memory selection signal which are outputted from said memory selection register and for outputting the selected character addresses and character color data to a column selection signal generation circuit and an output control circuit, respectively.

2. The circuit of claim 1, wherein said address ROM includes at least one address ROM each storing a character address and a character color data for comprising an on-screen display.

3. The circuit of claim 1, wherein said memory selection register includes 8bit registers MS0 through MS6 and CMS, of which a memory selection signal is stored in each of 8-bit registers MS0 through MS6 for selecting a character address and a color memory selection signal is stored in an 8-bit register CMS for selecting a character color data.

4. The circuit of claim 1, wherein said multiplexer includes a first multiplexer for outputting a character address outputted from an externally connected element in accordance with a memory selection signal and a second multiplexer for outputting a character color data outputted from an externally connected element in accordance with a color memory signal outputted from said memory selection register.

* * * * *